US009896966B2

(12) United States Patent
Petty

(10) Patent No.: US 9,896,966 B2
(45) Date of Patent: Feb. 20, 2018

(54) TIE ROD FOR A GAS TURBINE ENGINE

(75) Inventor: Dale William Petty, Wallingford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1341 days.

(21) Appl. No.: 13/220,640

(22) Filed: Aug. 29, 2011

(65) Prior Publication Data

US 2013/0052006 A1 Feb. 28, 2013

(51) Int. Cl.
*F01D 25/16* (2006.01)
*F01D 25/24* (2006.01)
*F01D 25/28* (2006.01)

(52) U.S. Cl.
CPC ..... *F01D 25/162* (2013.01); *F01D 25/24* (2013.01); *F01D 25/28* (2013.01); *Y10T 29/49323* (2015.01); *Y10T 403/46* (2015.01)

(58) Field of Classification Search
CPC ..... F01D 25/162; F01D 25/24; F01D 25/28; Y10T 29/49323; Y10T 403/46
USPC ..... 415/142, 210.1, 209.4; 248/65
See application file for complete search history.

(56) References Cited

U.S. PATENT DOCUMENTS

| | | | | |
|---|---|---|---|---|
| 529,222 | A | 11/1894 | Walton | |
| 3,722,215 | A * | 3/1973 | Zhdanov et al. | 60/800 |
| 4,086,946 | A * | 5/1978 | Keen | 411/279 |
| 4,965,994 | A | 10/1990 | Ciokajlo et al. | |
| 5,443,229 | A | 8/1995 | O'Brien et al. | |
| 5,452,575 | A | 9/1995 | Freid | |
| 6,000,906 | A * | 12/1999 | Draskovich | 415/209.4 |
| 6,883,303 | B1 | 4/2005 | Seda | |
| 7,409,819 | B2 | 8/2008 | Henry | |
| 7,490,460 | B2 | 2/2009 | Moniz et al. | |
| 7,490,461 | B2 | 2/2009 | Moniz et al. | |
| 7,493,753 | B2 | 2/2009 | Moniz et al. | |
| 7,493,754 | B2 | 2/2009 | Moniz et al. | |
| 7,513,103 | B2 | 4/2009 | Orlando et al. | |
| 7,526,913 | B2 | 5/2009 | Orlando et al. | |
| 7,579,087 | B2 | 8/2009 | Maloney et al. | |
| 7,594,404 | B2 | 9/2009 | Somanath et al. | |
| 7,594,405 | B2 | 9/2009 | Somanath et al. | |
| 7,603,844 | B2 | 10/2009 | Moniz et al. | |
| 7,610,763 | B2 | 11/2009 | Somanath et al. | |
| 7,632,064 | B2 | 12/2009 | Somanath et al. | |
| 7,677,047 | B2 | 3/2010 | Somanath et al. | |
| 7,685,808 | B2 | 3/2010 | Orlando et al. | |
| 7,726,113 | B2 | 6/2010 | Orlando et al. | |
| 7,752,836 | B2 | 7/2010 | Orlando et al. | |
| 7,762,087 | B2 | 7/2010 | Somanath et al. | |
| 7,775,049 | B2 | 8/2010 | Kumar et al. | |

(Continued)

FOREIGN PATENT DOCUMENTS

| | | |
|---|---|---|
| DE | 4015207 | 10/1991 |
| EP | 0799942 | 10/1997 |

(Continued)

OTHER PUBLICATIONS

European Search Report for European Application No. 12182030.2 completed Aug. 7, 2014.

*Primary Examiner* — Richard Edgar
(74) *Attorney, Agent, or Firm* — Carlson, Gaskey & Olds, P.C.

(57) ABSTRACT

A tie rod includes a gusset which extends between a rod and a base.

20 Claims, 10 Drawing Sheets

(56) References Cited

U.S. PATENT DOCUMENTS

| | | | | |
|---|---|---|---|---|
| 7,797,946 | B2 | 9/2010 | Kumar et al. | |
| 7,815,417 | B2 | 10/2010 | Somanath et al. | |
| 7,841,165 | B2 | 11/2010 | Orlando et al. | |
| 7,882,693 | B2 | 2/2011 | Schilling | |
| 7,905,083 | B2 | 3/2011 | Orlando et al. | |
| 7,921,634 | B2 | 4/2011 | Orlando et al. | |
| 7,926,259 | B2 | 4/2011 | Orlando et al. | |
| 8,371,249 | B1 * | 2/2013 | Little | 119/708 |
| 2002/0195793 | A1 * | 12/2002 | Gangwer | 280/400 |
| 2004/0211140 | A1 * | 10/2004 | Suzuki et al. | 52/393 |
| 2006/0171812 | A1 | 8/2006 | Albrecht | |
| 2008/0017226 | A1 | 1/2008 | Nobert | |
| 2009/0142182 | A1 * | 6/2009 | Kapustka | 415/142 |
| 2010/0135770 | A1 | 6/2010 | Durocher et al. | |
| 2011/0030387 | A1 | 2/2011 | Kumar et al. | |
| 2013/0011242 | A1 * | 1/2013 | Beeck et al. | 415/142 |

FOREIGN PATENT DOCUMENTS

| | | |
|---|---|---|
| JP | 2001259784 | 9/2001 |
| KR | 100995908 | 11/2010 |

* cited by examiner

TIE ROD FOR A GAS TURBINE ENGINE

BACKGROUND

The present disclosure relates to a gas turbine engine, and more particularly to a static structure thereof.

In a turbine section of a gas turbine engine, tie rods typically extend between an annular outer case structure and an annular inner case structure of a core path through which hot core exhaust gases are communicated. Each tie rod is often shielded by a respective aerodynamically shaped fairing.

The tie rods may be relatively thick to withstand engine vibrations and other load-bearing forces. Enlargement of the tie rods require relatively larger fairings which may result in relatively greater resistance to the hot core exhaust gasflow.

SUMMARY

A tie rod according to an exemplary aspect of the present disclosure includes a gusset which extends between a rod and a base.

A static structure of a gas turbine engine according to an exemplary aspect of the present disclosure includes a multiple of tie rods which radially extend between an annular inner turbine exhaust case and an annular outer turbine exhaust case, at least one of the multiple of tie rods include a gusset.

A method of assembling a multiple of tie rods into a gas turbine engine according to an exemplary aspect of the present disclosure includes positing a vane structure within an annular outer turbine exhaust case; inserting a tie rod into at least one vane of the vane structure, the tie rod includes a gusset between a base and a rod which extends from the base; securing the tie rod to an annular inner turbine exhaust case; threading a tie rod nut to an end section of the tie rod to a predefined torque; and securing the tie rod nut to the annular inner turbine exhaust case.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
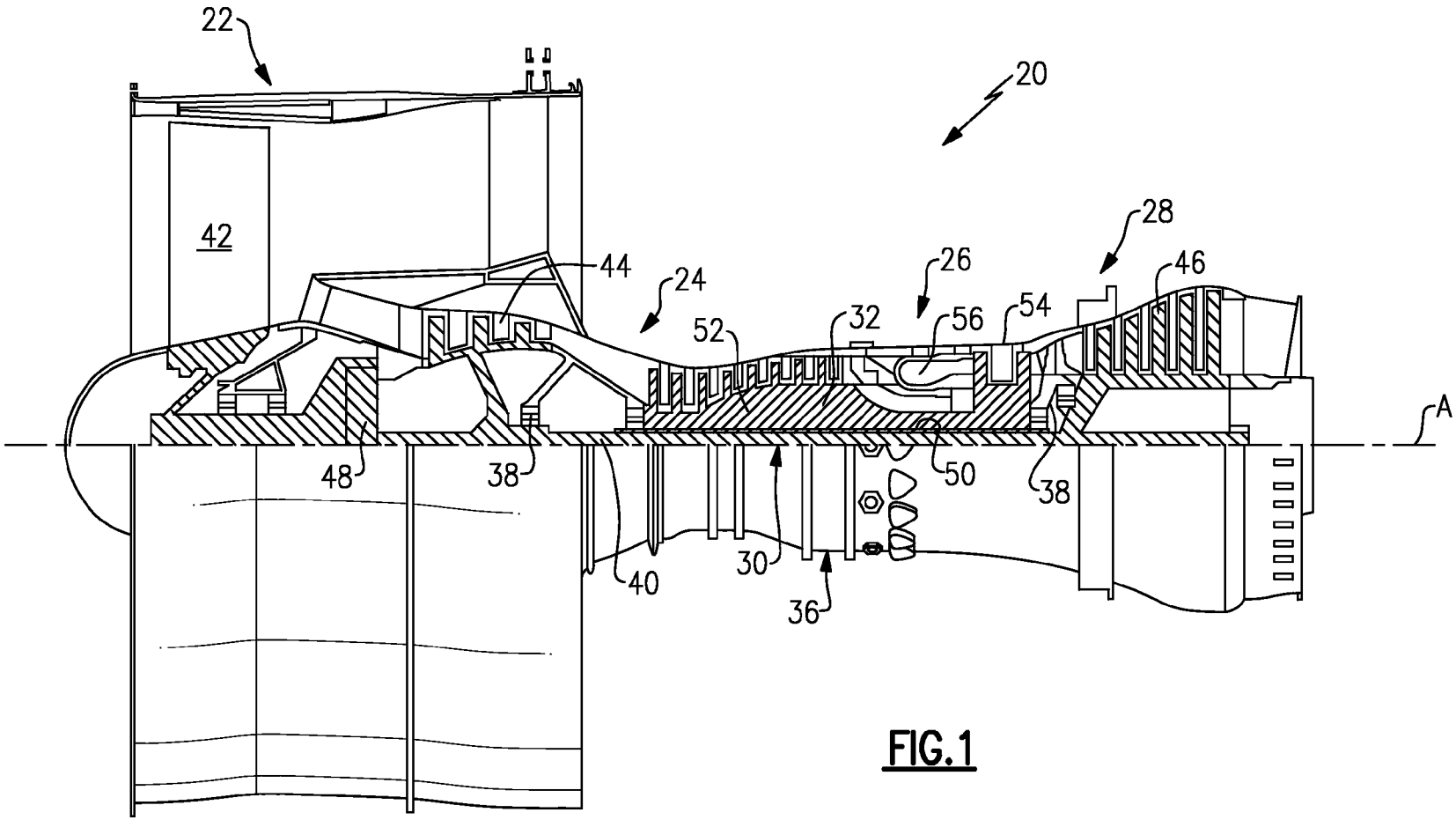
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings may be applied to other types of turbine engines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
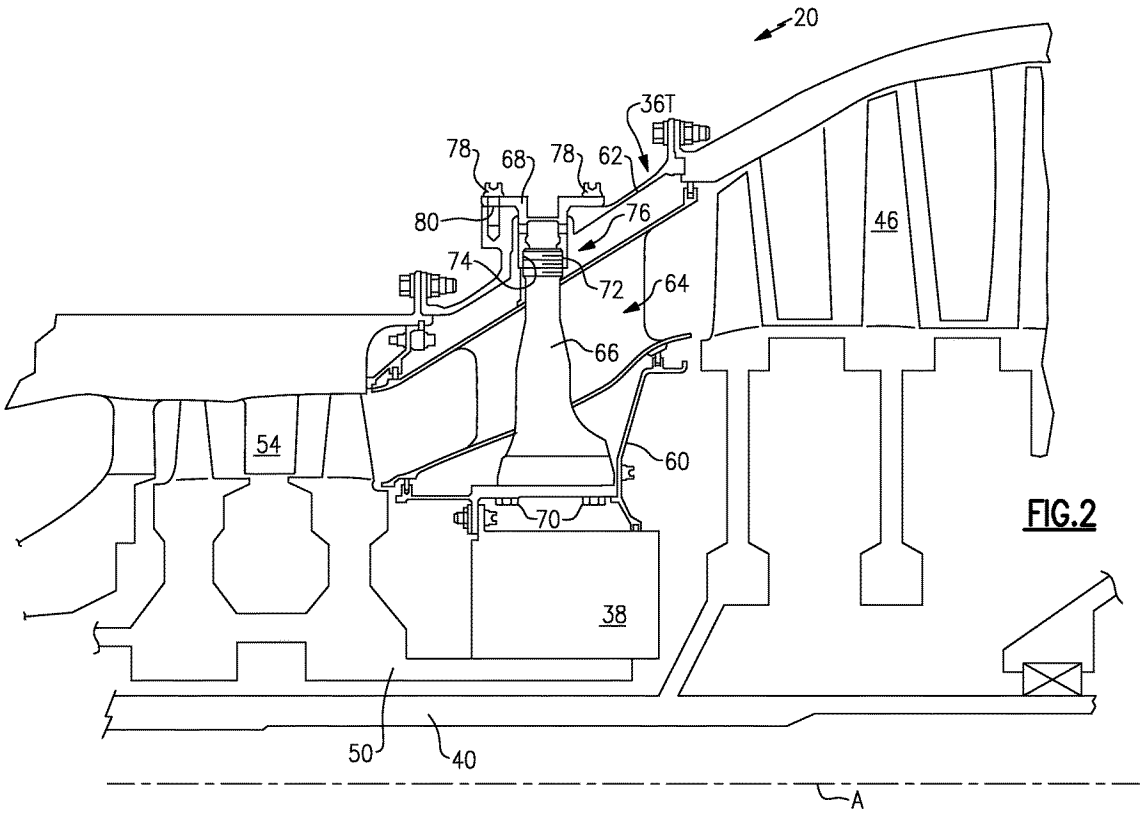
FIG. 2 is an enlarged sectional view of a Turbine section of the gas turbine engine.
Figure 3:
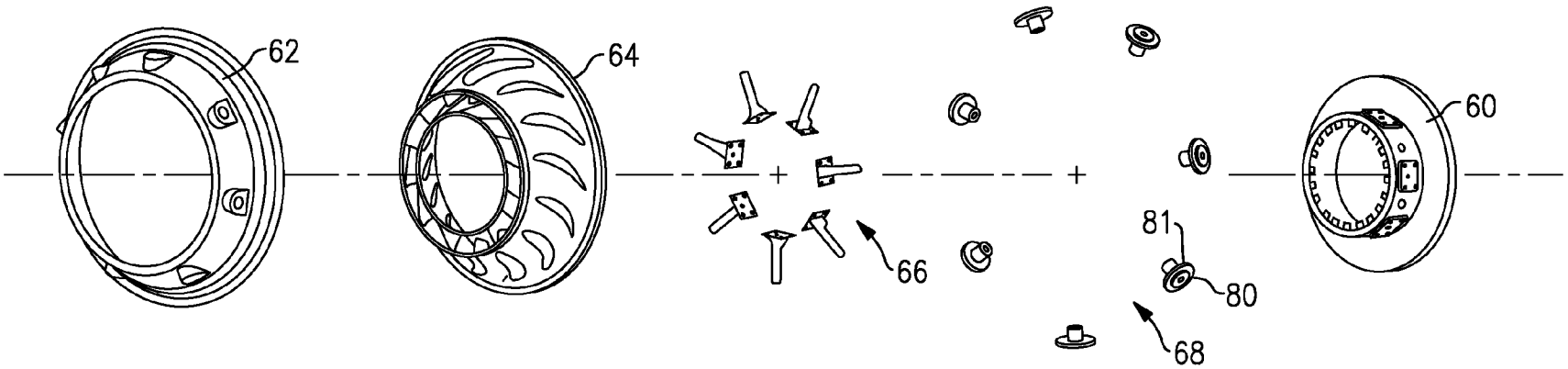
FIG. 3 is an exploded view a mid-turbine case structure of the turbine section.

With reference to FIG. 2, the turbine section 28 generally includes static structure 36T which is disclosed herein as a mid-turbine case of the gas turbine engine 20. The mid-turbine case static structure includes an annular inner turbine exhaust case 60, an annular outer turbine exhaust case 62, a vane structure 64, a multiple of tie rods 66 and a respective multiple of tie rod nuts 68 (also shown in FIG. 3). The annular inner turbine exhaust case 62 typically supports a bearing system 38 as well as other components such as seal cartridge structures within which the inner and outer shafts 40, 50 rotate.

Each of the tie rods 66 are fastened to the annular inner turbine exhaust case 60 through a multiple of fasteners 70 such that the annular outer turbine exhaust case 62 is spaced relative thereto. Each of the tie rods 66 are fastened to the annular outer turbine exhaust case 62 by the respective tie rod nut 68 which is threaded via an inner diameter thread 72 to an outer diameter thread 74 of an end section 76 of each tie rod 66.

Each tie rod nut 68 is then secured to the annular outer turbine exhaust case 62 with one or more fasteners 78 which extend thru "phone dial" holes 80 in the tie rod nut 68. That is, the multiple of holes 80 are arrayed in a circle within a flange 81 of each tie rod nut 68. The tie rod nut 68 is threaded to the end section 76 to a predefined torque, such that at least one of the "phone dial" holes 80 become aligned with respective apertures 82 in the annular outer turbine exhaust case 62 into which fasteners 78 (two shown in FIG. 2) are received to lock the tie rod nut 68 into position.

Figure 4:
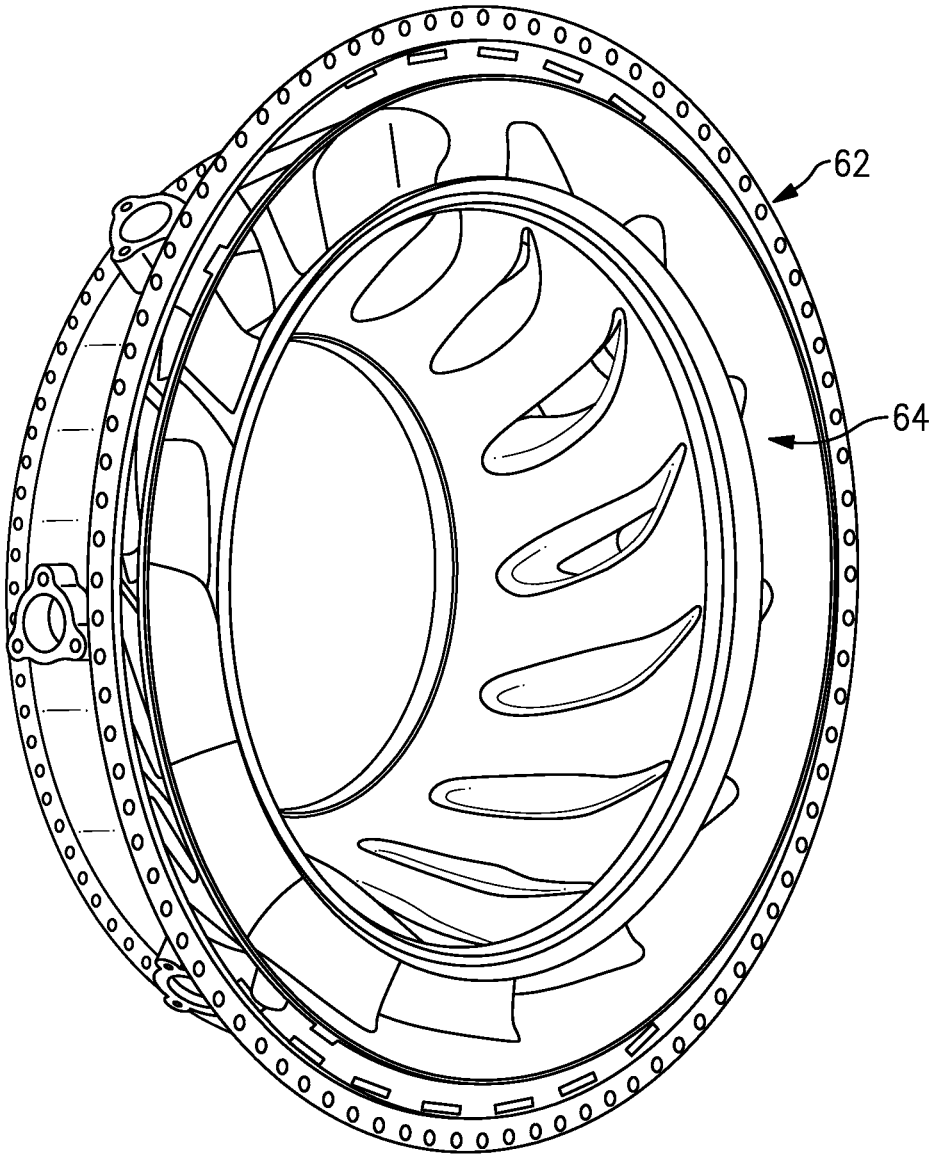
FIG. 4 is a rear perspective view of a vane structure located within the annular outer turbine exhaust case.
Figure 5:
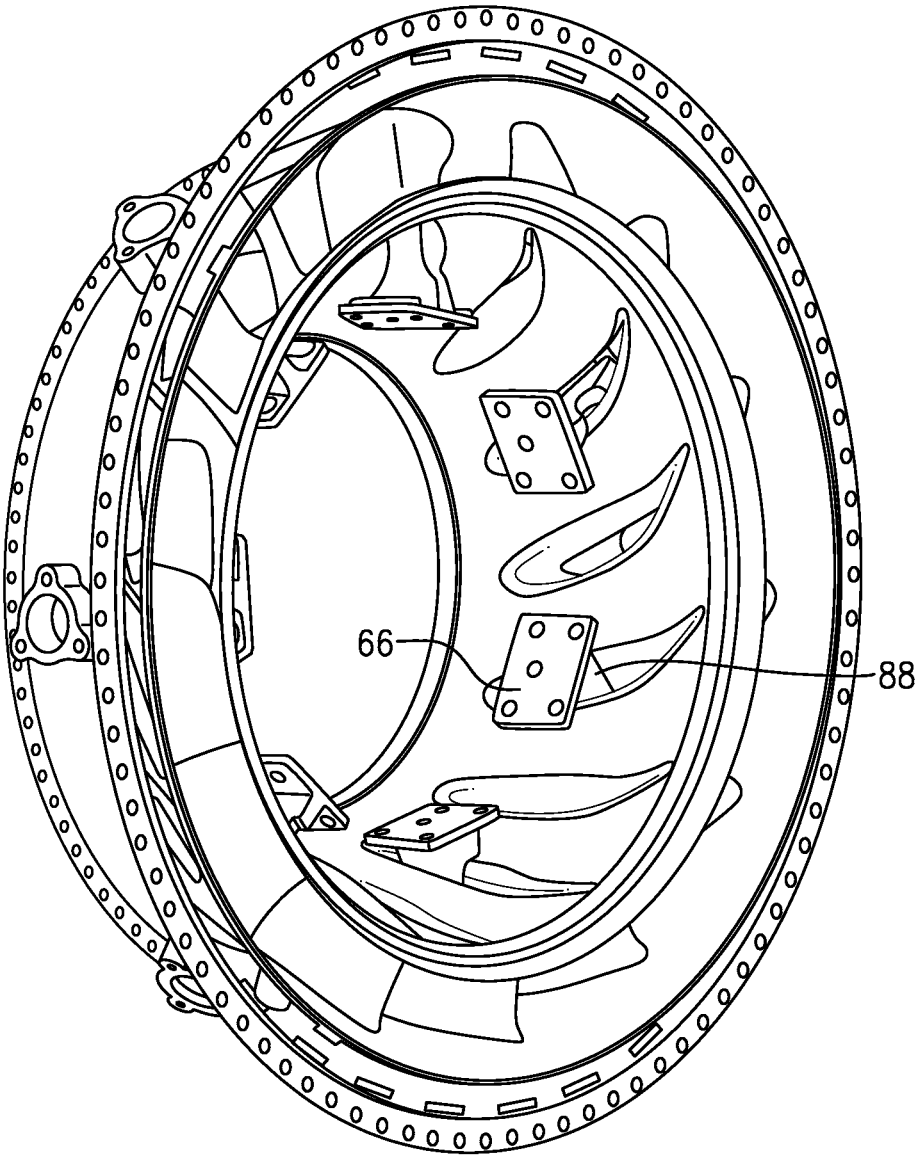
FIG. 5 is a rear perspective view of a multiple of tie rods inserted within the vane structure.
Figure 6:
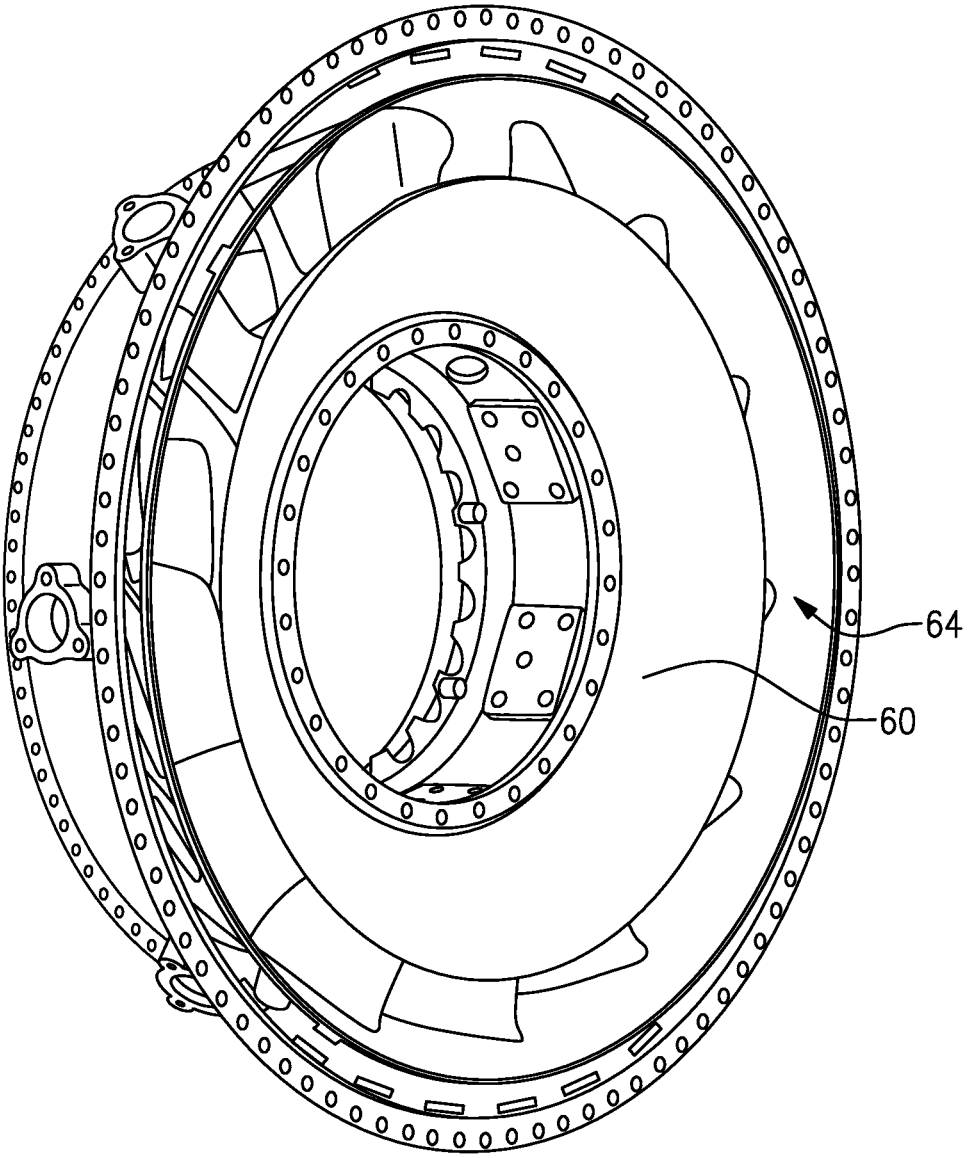
FIG. 6 is a rear perspective view of an annular inner turbine exhaust case located within the vane structure.
Figure 7:
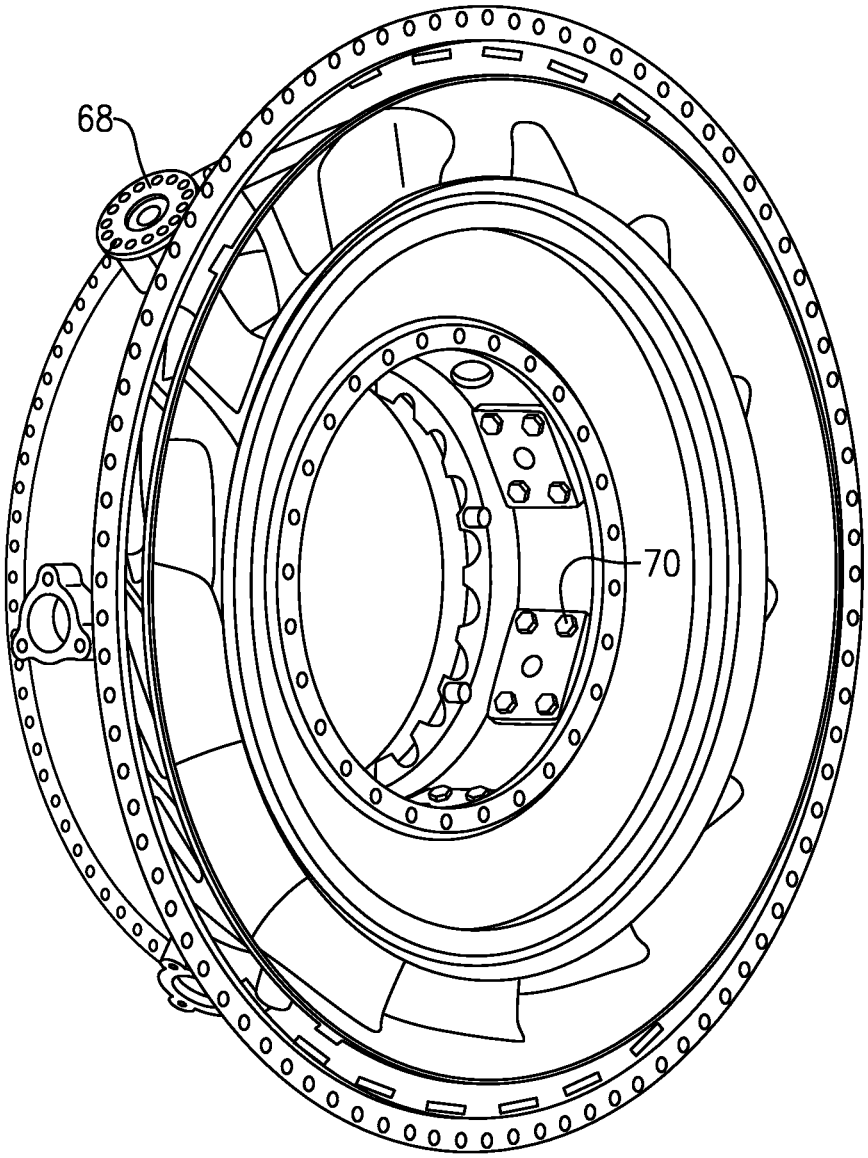
FIG. 7 is a rear perspective view of a multiple of tie rod nuts each threaded to an end section of each of the multiple of tie rods.

In a method of assembly, the vane structure 64 is located within the annular outer turbine exhaust case 62 (FIG. 4). Each of the multiple of tie rods 66 are then inserted into a multiple of vanes 88 of the vane structure 64 (FIG. 5). It should be appreciated that each vane 88 of the disclosed multiple need not include a tie rod 66. It should also be appreciated that the vane structure 64 may be manufactured of a multiple of sections or a single integral component which minimizes flow path leakage.

Figure 8:
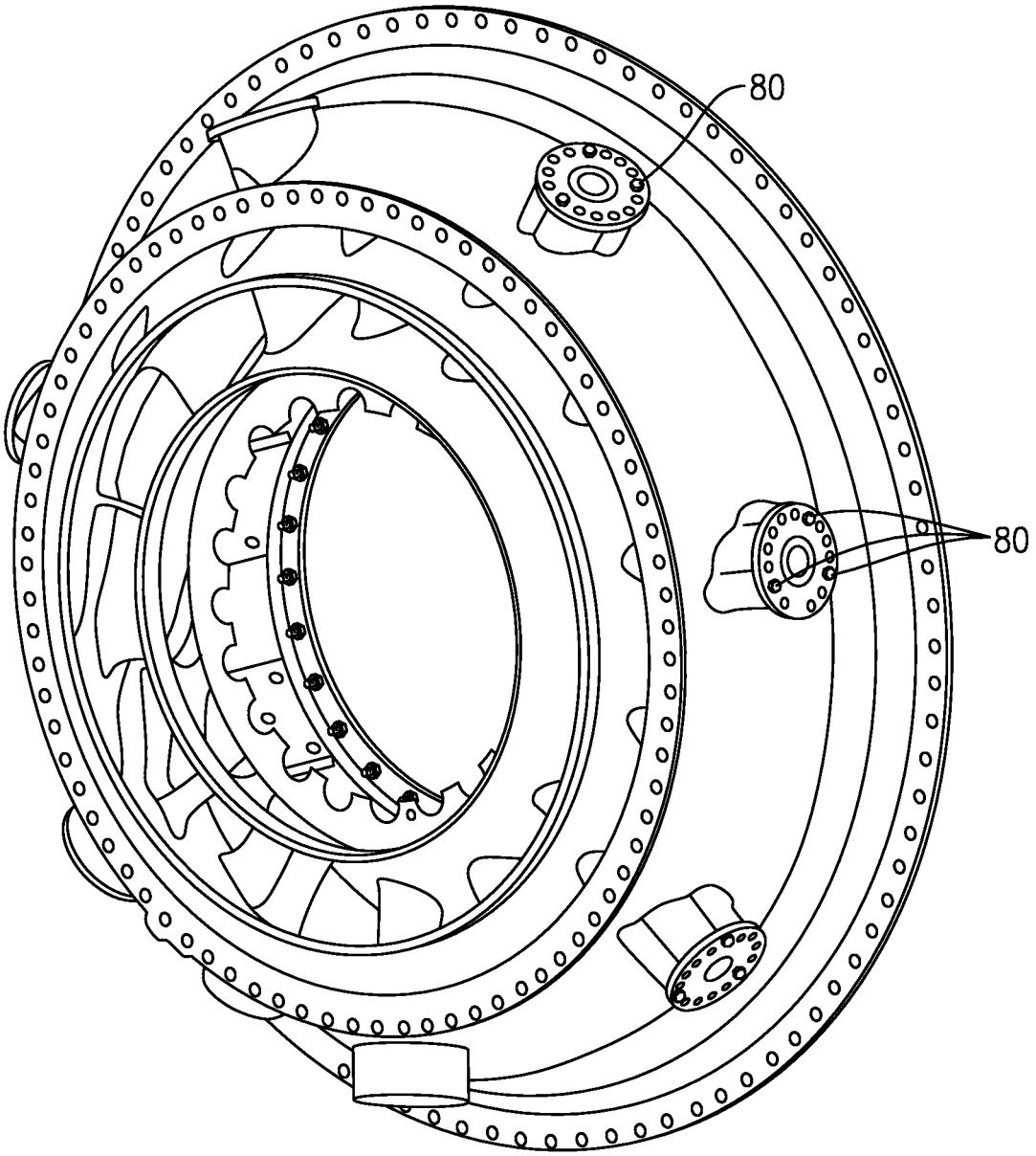
FIG. 8 is a front perspective view of a mid-turbine case structure of the gas turbine engine static structure.

The annular inner turbine exhaust case 60 is then inserted into the vane structure 64 and the multiple of tie rods 66 are secured thereto by the fasteners 70 which may be inserted from an inner diameter of the annular inner turbine exhaust case 60. The tie rod nut 68 is then threaded to the end section 76 of each of the multiple of tie rods 66 to the predefined torque to center the annular inner turbine exhaust case 60 therein along axis A (FIG. 8). The "phone dial" holes 80 are aligned with the respective apertures 82 in the annular outer turbine exhaust case 62 to receive the fasteners 78 and thereby lock the tie rod nut 68 into position.

Figure 9:
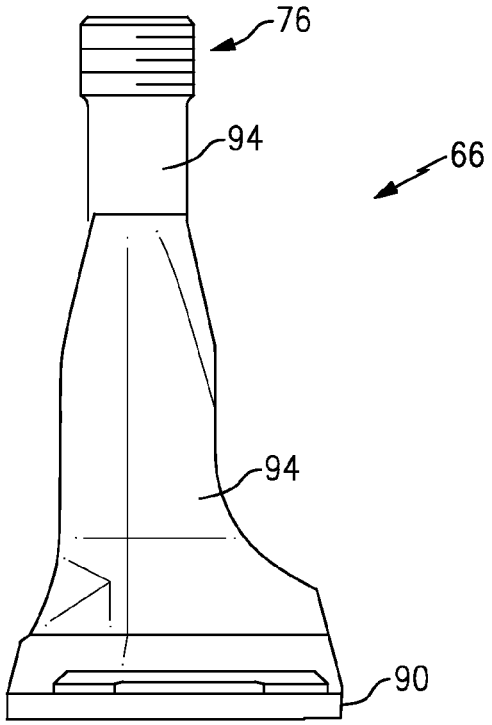
FIG. 9 is a side view of a tie rod according to one non-limiting embodiment.
Figure 10:
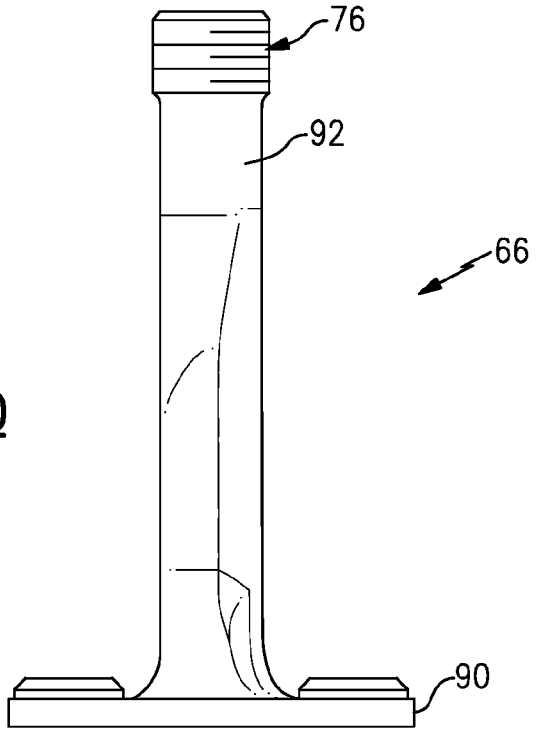
FIG. 10 is a front view of the tie rod of FIG. 9.
Figure 11:
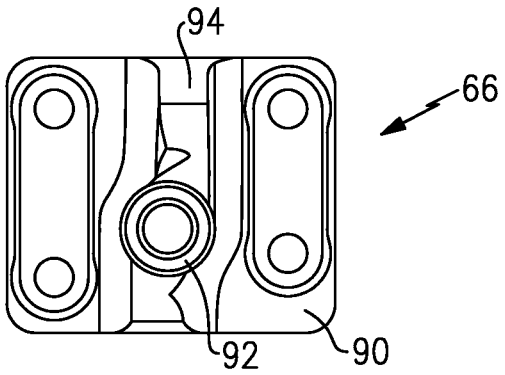
FIG. 11 is a top view of the tie rod of FIG. 9.

With reference to FIG. 9, each tie rod 66 generally includes a base 90, a hollow rod 92 which extends therefrom to the threaded end section 76 and at least one gusset 94 which extends between the base 90 and the hollow rod 92 (FIGS. 10 and 11). The hollow rod 92 may provide a secondary cooling air flow path therethrough. The tie rod 66 may be manufactured of a high temperature alloy such as Inco 718.

In the disclosed non-limiting embodiment, the gusset 94 may be generally triangular in shape to facilitate insertion into a respective vane 88 in the assembly method described above. That is, the gusset 94 is aligned generally fore and aft along the engine axis A with respect to the airfoils shaped vane 88. The gusset 94 further facilitates relatively smaller fairings to minimize resistance to the flow of the hot core exhaust gases through the turbine section yet minimize bending and dishing of the annular inner turbine exhaust case 60.

Figure 12:
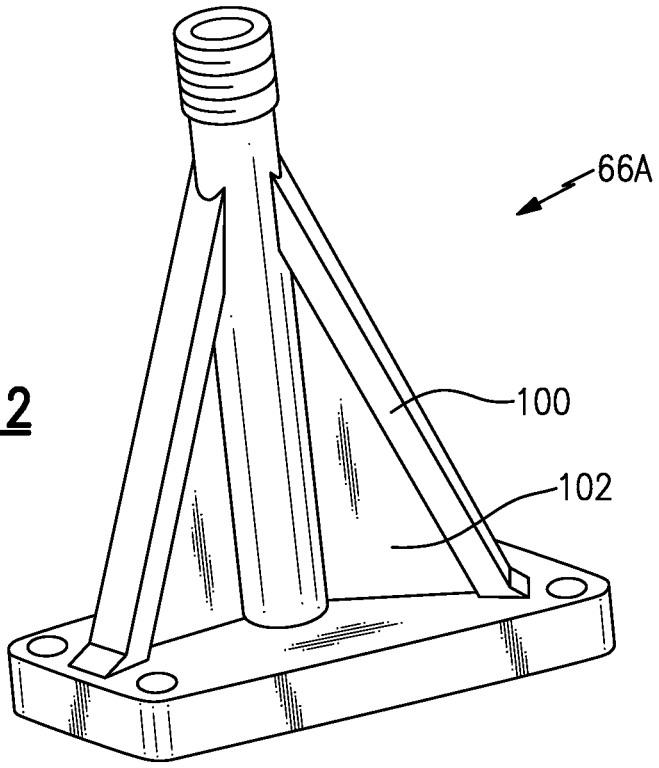
FIG. 12 is a perspective view of another tie rod according to another non-limiting embodiment.

With reference to FIG. 12, another non-limiting embodiment of a tie rod 66A is illustrated. The tie rod 66A includes a gusset 94 with a beam 100 and a web 102.

A large axial pressure load exists across this structure due to higher pressure upstream in the high pressure turbine (HPT) versus the lower pressures downstream in the low pressure turbine (LPT). The rod gussets provide a truss like structure that more effectively resists this load (and reduces axial deflection) than pure radial spoke like rods. Reducing axial deflection of the inner case limits seal excursions and better centers the bearing rolling elements on their races. The fact that the gussetted rods are removable, accommodates one piece flowpath vane assemblies (reduced gaspath leakage for improved efficiency).

A large axial pressure load typically exists across the mid-turbine case due to higher pressure upstream in the high pressure turbine 54 (HPT) versus the lower pressures downstream in the low pressure turbine 46 (LPT). The gussets 94 provide a truss like structure that more effectively resists this load (and reduces axial deflection) than conventional radial spoke like rods. Reductions in the axial deflection of the annular inner turbine exhaust case 60 limits seal excursions and better centers bearing rolling elements on their races of the bearing system 38. The tie rods 66 are removable to also accommodate a one piece flowpath vane structure 64 which provides for a reduced gaspath leakage and improved efficiency.

The tie rods 66 also resist out-of-plane bearing loads such as a blade-out unbalance condition, though the other forces may also apply which, for example, may be present if the engine architecture does not allow a bearing to be centered in the plane of the tie rod 66 or if the tie rod 66 straddles a bearing compartment that contains multiple bearing systems 38.

It should be understood that relative positional terms such as "forward," "aft," "upper," "lower," "above," "below," and the like are with reference to the normal operational attitude of the vehicle and should not be considered otherwise limiting.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A tie rod comprising:

a rod having an enlarged end in a form of a base plate and an opposed threaded end;

a gusset that slopes outwards axially from said rod and extends to said base plate; and a tie rod nut that includes an array of holes around a threaded opening that is threaded to said threaded end of said rod.

2. The tie rod as recited in claim 1, wherein said rod is hollow.

3. The tie rod as recited in claim 1, wherein said rod extends perpendicular to said base plate.

4. The tie rod as recited in claim 1, wherein said gusset is generally triangular.

5. The tie rod as recited in claim 1, wherein said base plate includes a multiple of apertures.

6. The tie rod as recited in claim 1, wherein said tie rod nut includes a flange, and said flange includes said array of holes.

7. The tie rod as recited in claim 1, wherein said gusset includes a beam and a web that extends between said beam, said rod, and said base plate.

8. A static structure of a gas turbine engine comprising:

an annular inner turbine exhaust case;

an annular outer turbine exhaust case;

a multiple of tie rods which radially extend between said annular inner turbine exhaust case and said annular outer turbine exhaust case, each of said multiple of tie rods including a rod having an enlarged end in a form of a base plate, a threaded end opposed said base plate, and a gusset that slopes outwards axially from said rod and extends to said base plate; and a multiple of tie rod nuts threaded to, respectively, said threaded ends of said tie rods, each of said tie rod nuts includes an array of holes with corresponding fasteners there through securing said tie rod nuts to said annular outer turbine exhaust case.

9. The static structure as recited in claim 8, wherein said base plate is fastened to said annular inner turbine exhaust case.

10. The static structure as recited in claim 8, further comprising a vane structure between said annular outer turbine exhaust case and said annular inner turbine exhaust case, each of said multiple of tie rods extend through a vane of said vane structure.

11. The static structure as recited in claim 10, wherein said base plate is fastened to said annular inner turbine exhaust case.

12. The static structure as recited in claim 8, wherein said annular outer turbine exhaust case is located between a high pressure turbine and a low pressure turbine.

13. The static structure as recited in claim 8, further comprising a plurality of vanes between said annular outer turbine exhaust case and said annular inner turbine exhaust case, said tie rods extend through, respectively, said vanes such that each said gusset is in said respective vane.

14. The static structure as recited in claim 13, wherein said annular inner turbine exhaust case and said annular outer turbine exhaust case extend about an engine central axis, and said gusset is aligned fore and aft along said engine central axis.

15. A static structure of a gas turbine engine, comprising:

an annular inner turbine exhaust case;

an annular outer turbine exhaust case;

a multiple of tie rods which radially extend between said annular inner turbine exhaust case and said annular outer turbine exhaust case, each of said multiple of tie rods including a rod having an enlarged end in a form of a base plate, a threaded end opposed said base plate, and a gusset that slopes outwards axially from said rod and extends to said base plate;

a tie rod nut threaded to, respectively, said threaded ends of each tie rod, said tie rod nut fastened to said annular outer turbine exhaust case, wherein said tie rod nut includes a multiple of holes arrayed in a circle.

16. A method of assembling a multiple of tie rods into a gas turbine engine comprising:

positioning a vane structure within an annular outer turbine exhaust case;

inserting a tie rod into at least one vane of the vane structure, the tie rod includes a rod having an enlarged end in a form of a base plate, a threaded end opposed said base plate, and a gusset that slopes outwards axially from said rod and extends to said base plate;

securing the base plate of the tie rod to an annular inner turbine exhaust case;

threading a tie rod nut to the threaded end of the tie rod; and securing the tie rod nut to the annular outer turbine exhaust case by locating fasteners through corresponding ones of an array of holes in the tie rod nut; and threading the fasteners to the annular outer turbine exhaust case.

17. The method as recited in claim 16, wherein threading the tie rod nut to the end section of the tie rod centers the annular inner turbine exhaust case within the annular outer turbine exhaust case.

18. The method as recited in claim 16, wherein the inserting of the tie rod into the at least one vane includes inserting the gusset into the at least one vane.

19. A method of assembling a multiple of tie rods into a gas turbine engine comprising:

positioning a vane structure within an annular outer turbine exhaust case;

inserting a tie rod into at least one vane of the vane structure, the tie rod includes a rod having an enlarged end in a form of a base plate, a threaded end opposed said base plate, and a gusset that slopes outwards axially from said rod and extends to said base plate;

securing the tie rod to an annular inner turbine exhaust case;

threading a tie rod nut to the threaded end of the tie rod; and securing the tie rod nut to the annular outer turbine exhaust case by locating at least one fastener through a phone dial hole in the tie rod nut; and threading the at least one fastener to the annular outer turbine exhaust case.

20. A method of assembling a multiple of tie rods into a gas turbine engine comprising:

positioning a vane structure within an annular outer turbine exhaust case;

inserting a tie rod into at least one vane of the vane structure, the tie rod includes a gusset between a base and a rod which extends from the base;

securing the tie rod to an annular inner turbine exhaust case by inserting fasteners from an inner diameter thereof;

threading a tie rod nut to an end section of the tie rod; and securing the tie rod nut to the annular outer turbine exhaust case.

* * * * *